United States Patent [19]

Hauschopp et al.

[11] 4,076,318

[45] Feb. 28, 1978

[54] CUTTER BIT ASSEMBLIES FOR COAL PLOUGHS

[75] Inventors: Alois Hauschopp, Werne; Oswald Breuer, Dortmund-Husen, both of Germany

[73] Assignee: Gewerkschaft Eisenhutte Westfalia, Lunen, Germany

[21] Appl. No.: 718,502

[22] Filed: Aug. 30, 1976

[30] Foreign Application Priority Data

Aug. 30, 1975 Germany ..... 2538682
Aug. 30, 1975 Germany ..... 2538648

[51] Int. Cl.[2] ..... E21C 35/18

[52] U.S. Cl. ..... 299/91; 37/142 R; 299/34

[58] Field of Search ..... 299/91, 34, 92, 93; 175/413; 37/142 R

[56] References Cited

U.S. PATENT DOCUMENTS

| | | | |
|---|---|---|---|
| 1,916,354 | 7/1933 | Barber | 37/142 X |
| 1,980,897 | 11/1934 | Winings | 37/142 R |
| 2,612,361 | 9/1952 | Hagenbook | 299/91 X |
| 2,680,597 | 6/1954 | Brown | 175/413 X |
| 2,841,896 | 7/1958 | Meshorer | 37/142 R |
| 3,203,488 | 8/1965 | Eastwood | 37/142 R X |

*Primary Examiner*—Ernest R. Purser
*Attorney, Agent, or Firm*—Sughrue, Rothwell, Mion, Zinn and Macpeak

[57] ABSTRACT

A cutter bit assembly is composed of a carrier or holder secured or integral with a coal plough and a cutter part detachably secured to the holder. The holder has a head piece with opposite plane faces extending transversally to the cutting direction. A bore in the head piece opens to these faces and extends parallel to the cutting direction. The cutter part has a plane face engageable on one of the transverse faces of the head piece and a projection and recess on these engageable faces prevents rotation of the cutter part. A threaded member either integral with or separate from the cutter part extends through the bore in the head piece and receives a nut bearing on the other of the transverse faces and used to detachably secure the cutter part to the head piece.

10 Claims, 4 Drawing Figures

CUTTER BIT ASSEMBLIES FOR COAL PLOUGHS

BACKGROUND TO THE INVENTION

The present invention relates to cutter bit assemblies for use with coal ploughs.

As is known a coal plough is moved along a coal face to strip coal therefrom by a planing action performed by a plurality of cutter bits. These cutter bits are subjected to high rates of wear, especially in the case of hard coal, and it is generally necessary to replace or re-sharpen the bits to achieve optimum performance. Usually the cutting edges themselves are provided by hard metal attachments. It is thus necessary to design the cutter bits to facilitate their replacement or removal in the difficult cramped working conditions in the mine working. This is especially the case with shallow coal seams where space is severely limited. The problem of replacement is also aggravated by the fact that it is sometimes desirable with known designs to provide a variety of cutters of different size to cope with the prevailing seam conditions.

It is a general object of this invention to provide a cutter bit assembly where a wide range of cutter part designs can be employed and where the attachment and detachment of the cutter parts can be performed simply. It is a further object of the invention to provide a cutter bit assembly where the cutter part is reliably secured to cope with all the forces acting on the assembly during its use.

SUMMARY OF THE INVENTION

In accordance with the invention a cutter bit assembly comprises a cutter part and a holder part, an elongate threaded member extending from the cutter part through the holder part in a direction substantially parallel to the intended cutting direction, a nut engaging on the threaded member to detachably secure the cutter part to the holder part, engaging faces on the holder and cutter parts which extend substantially perpendicularly to the intended cutting direction and at least one interengaging projection and recess between the holder and cutter parts to secure the cutter part against rotation about the axis of the threaded member. The invention also provides a holder part for use in the assembly and a cutter part for use in the assembly.

When the cutter part is to be replaced or exchanged the nut secured to the threaded member can be easily removed since it is remote from the cutting path of the cutter part and at an easily accessible region of the holder part.

This position for the nut is also advantageous in preventing damage thereto and allows the nut to be removed even after long period of use.

The interengaging faces of the parts ensure that the cutting forces can be transmitted to the holder part over a reasonably large area and the threaded member is not subjected to any unnecessarily large shear forces.

The assembly made in accordance with the invention may be used as a kerfing cutter or a floor cutter on the plough and similar cutter parts can be used throughout the plough regardless of its direction of movement. Normally just two sorts of cutter parts would be necessary for a plough, one serving for floor cutters and one for kerfing cutters.

It is usual to adjust the cutting depth of the plough by repositioning the holders and/or the cutter bits.

In accordance with the present invention a holder part may have several bores permitting the threaded member of a cutter part to be inserted to provide for such adjustment.

The threaded member may be formed integrally with the cutter part or separately therefrom. In either case, the threaded member preferably has a smooth shank closely fitted into a through bore in the holder part. This firmly locates the cutter part and enables forces directed transversally of the cutting direction to be transmitted to the holder part. An integral rod-like extension projecting from a face of the cutter part, constituting one of the interengaging faces, can provide the threaded member and ensures considerable stability for the connection between the holder and cutter parts. Nevertheless a separate bolt can be used as the threaded member. In this case a bore in the cutter part may receive the bolt, which also extends through the holder part, and this bore may have a recessed outer portion locating the non-circular head of the bolt to prevent its rotation. Thus, the nut can be tightened or loosened without difficulty.

In accordance with one constructional embodiment of the invention the cutter part may be wedge shaped with inclined cutting edges meeting at a juncture zone. The threaded member is then preferably positioned closer to a terminal surface of the cutter part opposite and remote from this juncture zone than it is to the juncture itself. The juncture zone is of course adjacent the coal face whilst the opposite terminal surface is adjacent the plough.

It is possible to have the holder part integral with the plough structure but where this is a separate component it may have a base inserted and secured into a pocket of the plough structure. This base may adjoin a head piece with first and second faces pierced by a bore receiving the threaded member with the first face constituting one of the interengaging faces of the assembly and the second face bearing the nut either directly or indirectly through the intermediary of a ring. With this construction an adjustment of the cutting depth can be achieved by repositioning the holder part. In both cases where the adjustment of the cutting depth involved re-positioning of the holder part on the plough or the cutter part on the holder part the same cutter part can be employed.

Where the assembly is to be used as a floor cutter it is desirable to have a cutter part with two cutting edges inclined at 90° to one another so that one edge acts on the floor while the other edge acts on the coal face. Preferably the holder part is then positioned at 45° in relation to the plough body.

The interengaging projection and recess preventing rotation of the cutter part may utilize the projection on the cutter part and the recess on the holder part or vice versa.

The invention may be understood more readily and various other features of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
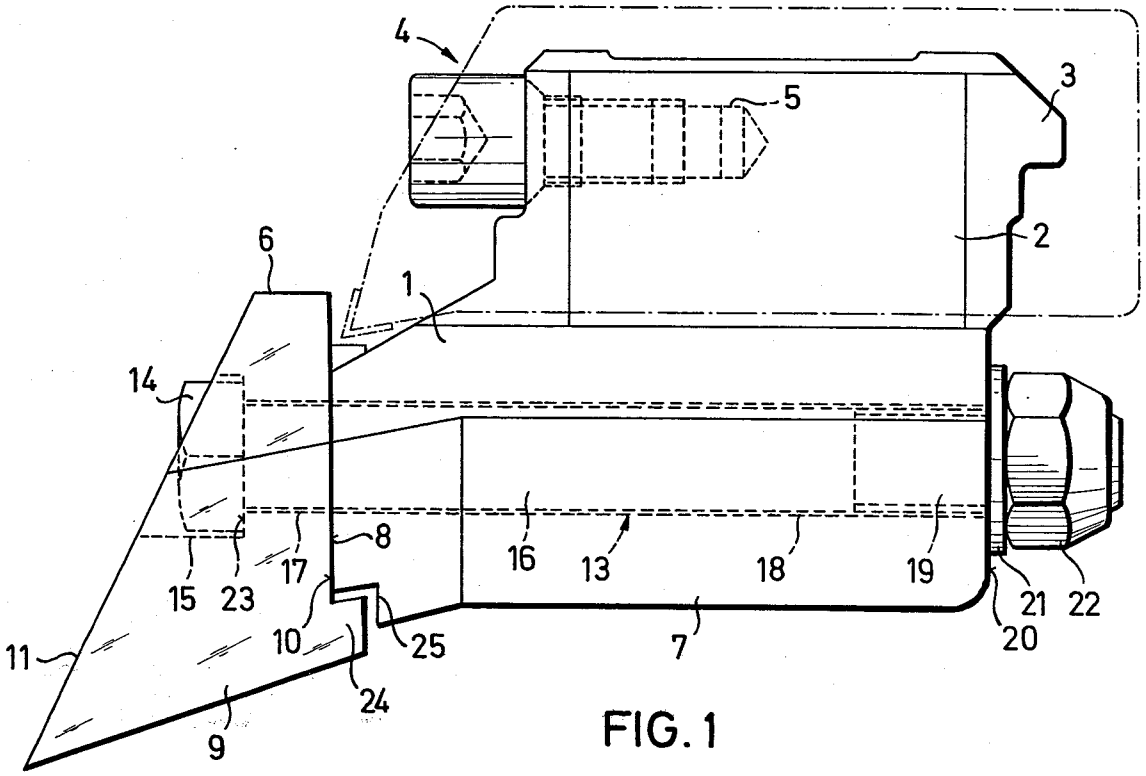
FIG. 1 is a side view of a cutter bit assembly made in accordance with the invention.
Figure 2:
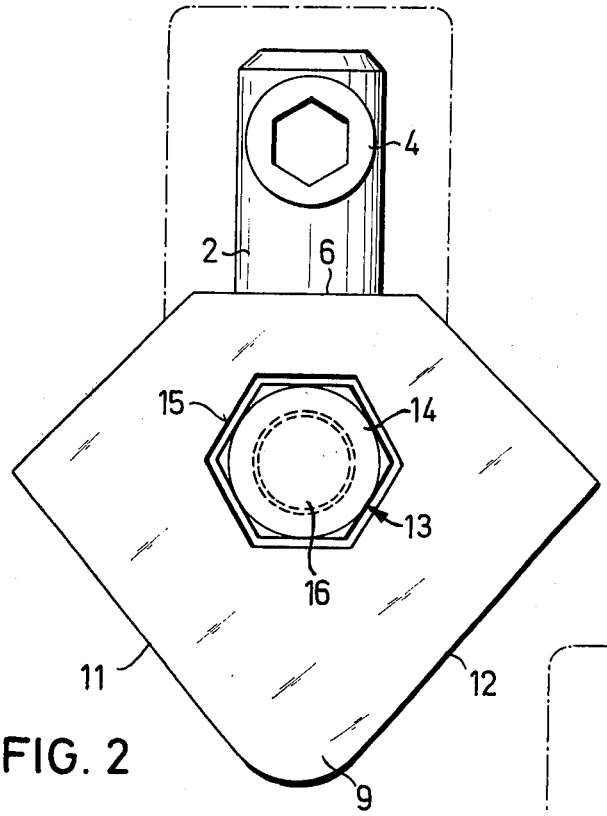
FIG. 2 is an end view of the assembly shown in FIG. 1.

As shown in FIGS. 1 and 2, a cutter bit assembly is composed of a holder or carrier part 1 and a cutter part or bit 9 detachably secured to the holder part 1. The holder part 1 has a head piece 7 engaged with the cutter part 9, and a base 2. The base 2 of the holder part 1 is received in a pocket in a plough structure indicated diagrammatically by a chain-dotted line. The base 2 has a hook-like projection 3 at one side which is received in a shaped recess in a wall of the pocket. A threaded bore 5 is provided in the base 2 and open towards the other side remote from the projection 3. A threaded member 4 is engaged in this bore 5 and extends through a wall such as a cross-piece of the plough structure. The projection 3 and the member 4 thus serve as means for detachably securing the holder part 1 to the plough.

The head piece 7 is provided with a central bore 18 parallel to the bore 5 and extending right through the head piece 7. The head piece 7 has plane side faces 8, 20 pierced by the bore 18 and extending perpendicularly to the bore 18 and to the cutting direction. A stepped recess 25 is provided at the juncture between the outermost end face of the head piece 7 and the side face 8.

The cutter part 9 has a body which engages on the reception face 8 of the head piece 7. The cutter part 9 is a wedge-shaped component with two inclined cutting edges 11, 12 as shown in FIG. 2. The cutter part 9 is preferably constructed from high grade steel and hard wear-resistant attachments can be provided on the body of the part 9 to define the cutting edges 11, 12. The cutter part 9 is provided with a bore 17 which aligns with the bore 18 in the head piece 7. The bore 17 is located in a position closer to the rear terminal face 6 of the part 9 opposite the juncture zone between the cutting edges 11, 12. The bore 17 adjoins a shaped recess 15 of greater diameter at the exterior of the cutter part 9. The recess 15 shaped to receive and lock the polygonal, e.g., hexagonal, head 14 of a threaded member in the form of a bolt 13 inserted through the bores 17, 18. The head 14 of the bolt 13 abuts against a shoulder 23 formed between the recess 15 and the bore 17. The bolt 13 has a smooth shank 16 closely fitted to the bore 18. The shank 16 has a screw-threaded end portion 19 which projects outwardly beyond the face 20 of the head piece 7 to receive a nut 22. A ring or washer 21 is interposed between the nut 22 and the face 20. The recess 15 ensures that the bolt 16 cannot rotate when its head 14 is seated therein so that the nut 22 can be tightened or loosened as desired. To ensure that the cutter part 9 does not rotate in relation to the head piece 7 the inner face 10 of the cutter part 9 which engages with the face 8 is provided with a projection 24 which engages in the recess 25 of the head piece 7.

Figure 4:
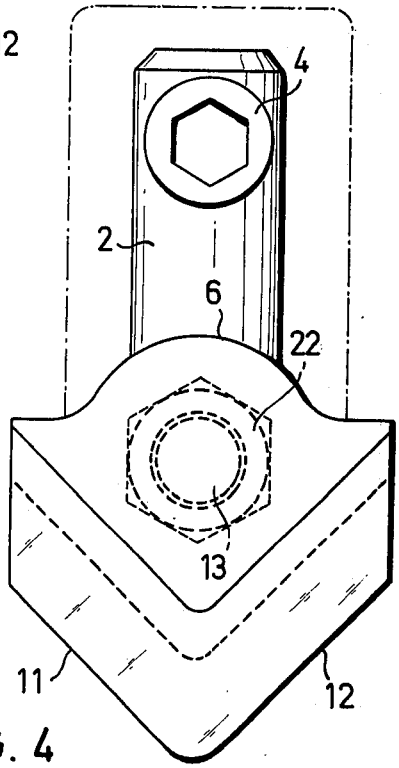
FIG. 4 is an end view of the assembly shown in FIG. 3.
Figure 3:
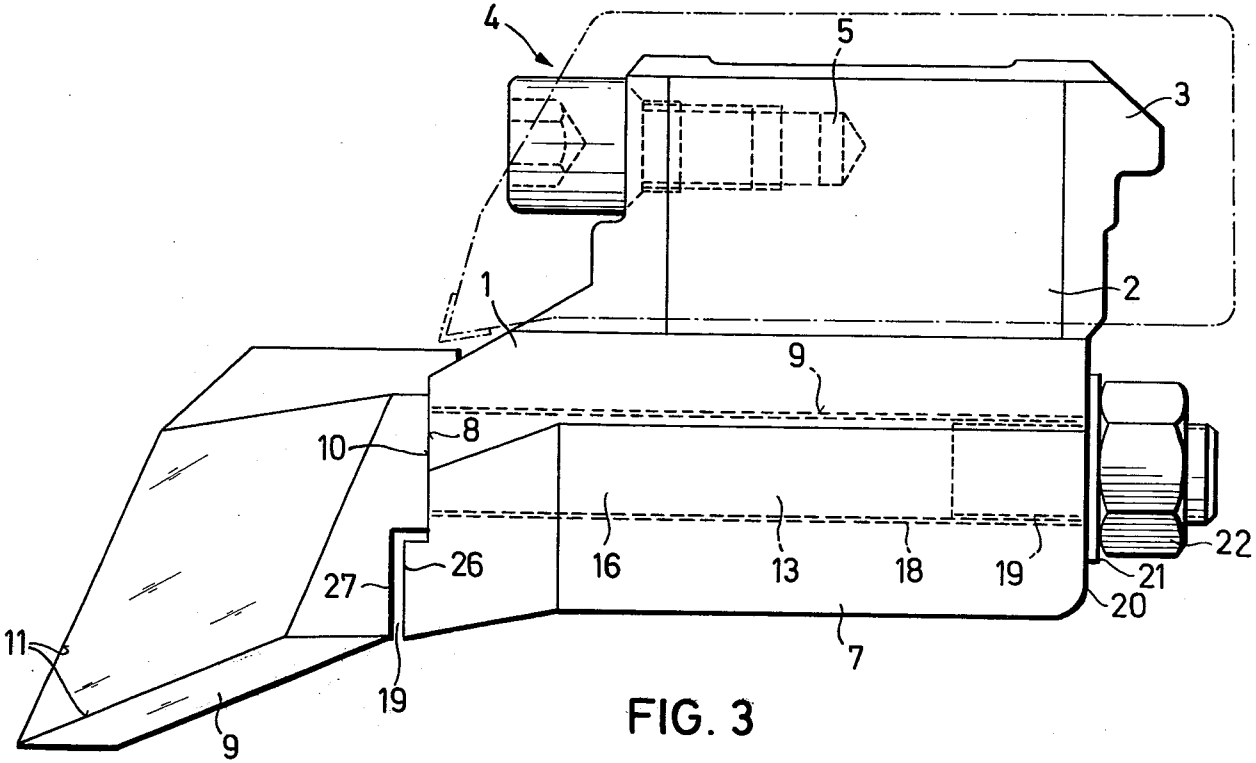
FIG. 3 is a side view of another cutter bit assembly made in accordance with the invention.

The cutter bit assembly shown in FIGS. 3 and 4 is structurally similar to the assembly of FIGS. 1 and 2 and like reference numerals are used to denote like and analogous parts. One main difference between the respective assemblies is that in the case of FIGS. 3 and 4 the cutter part 9 is formed with an integral rod-like extension 13 as a threaded member analogous to the bolt 13 of FIGS. 1 and 2. This rod extension 13 engages in the bore 18 and has the threaded end portion 19 engaged by the nut 22 as before. In contrast to FIGS. 1 and 2, the head piece 7 is wedge shaped and, has a stepped projection 26 on the side face 8 as opposed to the recess 25 in FIGS. 1 and 2. This projection 26 engages in a recess 27 on the abutting inner face 10 of the cutter part 1.

In other constructions made in accordance with the invention the holder part 1 is not formed separately but is instead integral with the plough structure. A holder of this type may have several bores (18) each receiving or capable of receiving the bolt 13 (FIGS. 1 and 2) or equivalent extension 13 (FIGS. 3 and 4) of a cutter part 9. A cutter part 9 can then be re-positioned in a different position to provide adjustment of the cutting depth. Alternatively the holder part 1 can be re-positioned on the plough to adjust the cutting depth.

We claim:

1. In a coal plough having a pocket for receiving the holder of a cutter bit assembly, the improvement comprising a cutter bit assembly having a cutter part and a holder part, the holder part having a base which is insertable into the pocket of the coal plough, and a headpiece, an elongate threaded member extending from the cutter part through the headpiece of the holder part in a direction substantially parallel to the intended cutting direction, a nut engaging on the threaded member to detachably secure the cutter part to the holder part, engaging faces on the headpiece and the cutter part which extend substantially perpendicularly to the intended cutting direction, and at least one interengaging projection and recess between the headpiece and the cutter part to secure the cutter part against rotation about the axis of the threaded member.

2. An assembly according to claim 1, wherein the threaded member has a smooth circular shank closely fitting in a through bore in the holder part.

3. An assembly according to claim 1, wherein the threaded member is formed integrally with the cutter part.

4. An assembly according to claim 1, wherein the threaded member is separable from the cutter part and has a non-circular head which seats in a shaped recess in the cutter part to prevent rotation of the member.

5. An assembly according to claim 1, wherein the cutter part is wedge shaped with inclined cutting edges meeting at a juncture zone and the threaded member is located in a position which is closer in distance to a terminal surface of the cutter part opposite to said juncture zone than the distance from the threaded member to the juncture zone.

6. An assembly according to claim 1, wherein the holder part has a base and a head piece with a first face forming one of the interengaging face and a second face opposite said first face, the first and second faces being pierced by a bore receiving the threaded member with the nut bearing on the second face and wherein the base of the holder part is insertable into a pocket of a coal plough structure.

7. In or for an assembly according to claim 1, a cutter part having a body with a face engageable on a face of the holder part to form said interengageable faces, an integral rod-like extension projecting outwardly from said face and constituting said threaded member and means on said face to co-operate with the holder part in defining said interengaging projection and recess.

8. In or for an assembly according to claim 1, a cutter part having a body with a face engageable on a face of the holder part to form said interengageable faces, means on said face to co-operate with the holder part in defining said interengaging projection and recess, a bore extending through the body to pierce said face for receiving a bolt with a non-circular head constituting said threaded member and a recess at an end of the bore remote from said face for locating the head of the bolt to prevent rotation thereof.

9. In or for an assembly according to claim 1, a holder part with a head piece with first and second opposite faces pierced by a bore for receiving the threaded member and means on the first face to co-operate with the cutter part in defining said interengaging projection and recess.

10. A cutter bit assembly for a coal plough; said assembly comprising a cutter part and a holder part, the holder part having a base, which is insertable into a complementary pocket provided in the coal plough, and a headpiece, an elongate threaded member extending from the cutter part through the headpiece of the holder part in a direction substantially parallel to the intended cutting direction, a nut engaging on the threaded member to detachably secure the cutter part to the holder part, engaging faces on the headpiece and the cutter part which extend substantially perpendicularly to the intended cutting direction, and at least one interengaging projection and recess between the headpiece and the cutter part to secure the cutter part against rotation about the axis of the threaded member, wherein the threaded member has a smooth circular shank closely fitting in a through bore in the headpiece of the holder part, wherein the cutter part is wedge shaped with inclined cutting edges meeting at a juncture zone and the threaded member is located in a position which is closer in distance to a terminal surface of the cutter part opposite to said juncture zone than the distance from the threaded member to the juncture zone, and wherein the headpiece of the holder part has a first face forming one of the interengaging faces and a second face opposite said first face, the first and second faces being pierced by the bore receiving the threaded member with the nut bearing on the second face.

* * * * *